US012779614B2

(12) United States Patent
Stallegger

(10) Patent No.: US 12,779,614 B2
(45) Date of Patent: Nov. 3, 2026

(54) KNIFE SHARPENING DEVICE WITH HOLDING POINTS

(71) Applicant: Rosita Stallegger

(72) Inventor: Harald Stallegger, Pöndorf (AT)

( * ) Notice: Subject to any disclaimer, the term of this patent is extended or adjusted under 35 U.S.C. 154(b) by 773 days.

(21) Appl. No.: 16/966,648

(22) PCT Filed: Jan. 31, 2019

(86) PCT No.: PCT/EP2019/052439
§ 371 (c)(1),
(2) Date: Jul. 31, 2020

(87) PCT Pub. No.: WO2019/149855
PCT Pub. Date: Aug. 8, 2019

(65) Prior Publication Data

US 2021/0031325 A1 Feb. 4, 2021

(30) Foreign Application Priority Data

Feb. 1, 2018 (DE) ..... 10 2018 102 273.5

(51) Int. Cl.
*B24B 3/54* (2006.01)

(52) U.S. Cl.
CPC ..... *B24B 3/54* (2013.01)

(58) Field of Classification Search
CPC .... B24B 3/36; B24B 3/52; B24B 3/54; B24B 19/001; B24B 19/002; B24D 15/06; B24D 15/063; B24D 15/065; B24D 15/08; B24D 15/081
See application file for complete search history.

(56) References Cited

U.S. PATENT DOCUMENTS 1,041,631 A * 10/1912 Johnson ..... B24D 15/081 76/86
1,165,245 A * 12/1915 Goodwin ..... B24D 15/081 76/86
4,441,279 A 4/1984 Storm et al.
5,440,953 A * 8/1995 Gangelhoff ..... B24D 15/081 76/86
7,172,500 B1 2/2007 Wu
(Continued)

FOREIGN PATENT DOCUMENTS

CN 2836988 Y 11/2006
CN 200984711 Y 12/2007
(Continued)

*Primary Examiner* — Craig M Schneider
(74) *Attorney, Agent, or Firm* — Thompson Coburn LLP

(57) ABSTRACT

A knife sharpening device having a plate with two sharpening rods, which are mounted on the plate so that they can swivel. The plate has a slot, which is open at one end and closed at the opposite end. The arrangement of the sharpening rods and the slot are in axial alignment with each other and serve to insert a knife. The sharpening rods each have at least one sharpening insert. The sharpening rods are kept at a predetermined distance from each other in a rest position by the force of one spring in each case. The sharpening rods can be spread apart against the force of the spring in a sharpening position upon insertion of the knife when the knife comes into contact with the sharpening inserts. The plate has at least one point, at which at least one sharpening rod is held relative to the plate.

25 Claims, 5 Drawing Sheets

(56) References Cited

U.S. PATENT DOCUMENTS

| | | | | |
|---|---|---|---|---|
| 8,262,438 | B1 | 9/2012 | Allison et al. | |
| 9,469,014 | B2 * | 10/2016 | Vogel | B24D 15/082 |
| 2004/0014415 | A1 * | 1/2004 | Stallegger | B24D 15/081<br>451/555 |
| 2007/0224922 | A1 * | 9/2007 | Stallegger | B24D 15/081<br>451/45 |
| 2010/0018352 | A1 * | 1/2010 | Rieser | B24D 15/08<br>76/84 |
| 2014/0154963 | A1 * | 6/2014 | Jhones | B24D 15/081<br>29/434 |

FOREIGN PATENT DOCUMENTS

| | | | |
|---|---|---|---|
| CN | 203804808 | U | 9/2014 |
| CN | 204843888 | U | 12/2015 |
| CN | 106271909 | A | 1/2017 |
| DE | 100 44 614 | A1 | 5/2001 |
| DE | 100 52 439 | C1 | 10/2001 |
| DE | 602006000230 | T2 | 9/2008 |
| DE | 10 2007 061 535 | B4 | 3/2017 |
| EP | 0547001 | A1 * | 6/1993 |
| EP | 1328379 | A1 | 7/2003 |
| GB | 293785 | A | 7/1927 |
| GB | 617022 | A | 1/1949 |

* cited by examiner

KNIFE SHARPENING DEVICE WITH HOLDING POINTS

CROSS-REFERENCE TO RELATED APPLICATIONS

This application is a national phase application of and claims priority to PCT application PCT/EP2019/052439 filed on Jan. 31, 2019, which claims priority to German Patent Application No. DE 10 2018 102 273.5, filed Feb. 1, 2018, and titled KNIFE SHARPENING DEVICE WITH HOLDING POINTS, all of which are incorporated by reference in their entirety herein.

FIELD OF INVENTION

The invention relates to a knife sharpening device comprising a plate for rotatably holding two sharpening rods relative to the plate according to the features of the pre-characterising part of claim 1.

BACKGROUND

A knife sharpening device is known from DE 10 2007 061 535 B4, which has a holder on which two intersecting sharpening rods are rotatably mounted and loaded towards each other by means of spring pressure. The knife sharpening device has a knife insertion slot which is open at one end and extends in the direction of an intersection of the sharpening rods.

In this way, the sharpening rods are pressed apart against the restoring force of the spring from a rest position, in which the sharpening rods assume a crossing angle, into a sharpening position. For honing the knife, the sharpening rods can be locked in a sharpening position by means of a locking device in which the crossing angle of the sharpening rods is greater than the crossing angle in the rest position.

The rest position corresponds to a state of non-use. In contrast, the sharpening position denotes a position of the knife sharpening device in which the blade of the knife with or without a serrated edge can be ground and/or honed and/or polished.

Known knife sharpening devices require for each sharpening rod a plurality of fastening means for arranging the sharpening rods on the carrier plate of the knife sharpening device. If an excessive restoring force is applied to the blade of the knife when it is inserted into the slot in the plate of the knife sharpening device or if the blade of the knife to be sharpened is tilted when it is inserted into the plate, material is scraped off the plate.

This can also cause damage to the blade of the knife to be sharpened.

The scraped-off or shaved-off material chips can adhere to the knife sharpening device. This can cause the chips to come into unintentional contact with the sharpening inserts or the blade of the knife. The material chips can also get between the knife and the sharpening insert during a subsequent sharpening process and prevent the knife from being optimally sharpened.

In the case of other known knife sharpening devices, dirt on the knife blade can get onto the springs and/or the sharpening inserts and prevent an optimal sharpening process.

Other known knife sharpening devices prove to be disadvantageous, as the sharpening inserts and/or the springs of the knife sharpening devices are located within the area of influence of the user's hands, which can cause injuries to the user's hands.

Other known knife sharpening devices comprise a large number of individual parts, which require considerable technical expertise to assemble and replace spare parts. The large number of individual technical parts can cause damage to the knife sharpening device during assembly by the user.

In addition, the large number of individual technical parts increases the manufacturing, repair and maintenance costs of the knife sharpening device.

Moreover, a non-variable spring force of many known knife sharpening devices leads to the fact that such devices cannot be used for knife blades of different type and quality.

SUMMARY

Therefore, the problem of the present invention is to provide a knife sharpening device with which the blades of knives of different type, quality and function can be reground and/or honed and/or polished with one single knife sharpening device.

A knife sharpening device shall be provided in which, in particular, the springs and the sharpening inserts are arranged in such a way that the risk of injury to the user, although not entirely avoided, can be virtually eliminated.

In addition, a knife sharpening device shall be provided which ensures that the blade of the knife to be sharpened cannot be damaged by contact with housing parts, metallic springs and other parts of the knife sharpening device when inserted into the slot of the knife sharpening device.

Components of the knife sharpening device, for example sharpening inserts for grinding and/or honing or polishing the knife as well as the springs, should be protected from dirt, especially from food residues adhering to knife blades. The term 'grinding of the knife' also includes the term 'sharpening of the knife'.

It should also be possible for the knife sharpening device to be cleaned by a user who does not have any technical experience.

Compared to other knife sharpening devices known from the state of the art, the knife sharpening device is to comprise a smaller number of components and parts. The manufacturing costs of the knife sharpening device shall thus be significantly reduced.

The insertability of the blade of the knife to be ground into the slot of the plate shall be improved. In addition, the knife sharpening device shall be capable of being used for knives of any type and quality, for single-bevelled blades as well as for multi-bevelled knife blades.

The problems are solved by a knife sharpening device according to the features of claim 1.

Advantageous implementations and variants of the invention are described in the subclaims.

A knife sharpening device within the meaning of the invention is understood to be a device which is configured to sharpen and/or grind and/or hone and/or polish knives, scissors and other tools for the chipless separating or cutting of different materials.

In the following, it is assumed by way of non-limiting example that the knife sharpening device is used for sharpening, grinding, honing and/or polishing knife blades.

The knife sharpening device comprises at least one plate having a slot. The slot is open at one end and closed at the opposite end. For the insertion of a knife, the slot in the plate can be configured in the form of a slot-like or elliptical recess.

The slot can also be formed by two plate parts arranged side by side. These parts, too, are referred to as a plate in the present case.

In addition, the knife sharpening device comprises sharpening rods which, in a rest position, are arranged at a predetermined angle relative to each other by the force of one spring in each case. The two sharpening rods are arranged side by side. The two sharpening rods can also be arranged so as to overlap each other.

The rest position is the position of the knife sharpening device in which the knife blade has not yet been inserted into the slot of the plate and not yet between the sharpening rods.

Each sharpening rod is held by means of one or more springs. Due to the restoring force of the springs, the two sharpening rods assume a predetermined angle relative to each other.

Plate

The term 'plate' refers to a flat component that comprises at least one rigid material. The plate is arranged on a stand in a preferably vertical orientation so as to be captive.

A bore is provided in the plate at least at the lower end of the slot. Grip elements are provided on the outer edges of the plate facing away from the slot.

The slot, the bores and the grip elements are described in detail below.

Slot

According to the invention, the term 'slot' is understood to mean an elongated and/or chamfered and/or angular cut in the plate. The slot extends in the plate transversely to a plane in which the plate runs. The slot can be sawn into the plate. The slot can also be milled. It can also be formed by two plate parts arranged adjacent to each other or by rods.

The slot preferably extends within the plate from its upper edge downwards towards the stand, on which the plate is mounted for vertical arrangement.

The width of the slot can vary over the length of the slot.

The lower end of the slot can be in the plate itself or be formed by the stand, in particular if the plate consists of plate parts that are arranged side by side.

The edges of the slot within the plate have single- or multi-curved shapes. Alternatively, the edges of the slot are straight. However, they can also have any other geometric shape.

An implementation of the invention provides that the slot in the plate has a width which increases exponentially from its closed end towards its open end.

At its upper edge, the plate has an insertion area, which serves to facilitate the insertion of the knife into the slot of the plate and between the two sharpening rods. For this purpose, the insertion area of the slot is configured in such a way that it is wider than the area of the slot at its closed end.

This can facilitate the insertion of wider blades in particular. In addition, the material of the plate is prevented from being damaged when the blade is inserted into the slot.

It is prevented that the material of the plate and/or the material of the sharpening rods is scraped and/or cut and/or damaged in any other technical way when the knife is inserted between the sharpening inserts of the sharpening rods, which are preferably arranged in a V-shape.

By way of non-limiting example, the edges of the slot in the insertion area of the slot can include an angle ranging from 80° to 120° or more.

In addition, the plate has bores, which will be described in more detail below.

Grip Element

'Grip element' means a device with which the blade sharpening device can be gripped and/or held and/or moved by the user. Preferably, the grip element is formed as part of the plate.

The grip element can be made of the same material or materials as the plate. The grip element may be made of at least one material which differs in type and quality from the at least one material of the plate.

The grip element is configured in such a way that the user can hold the knife sharpening device in a non-slip and/or captive manner.

The grip element can have at least one profile.

The grip element can be integrally connected to the material of the plate. The grip element can also be formed in such a way that it can be removed from the plate.

Bore

In the area of the open end of the slot, one bore is provided in the plate on each side of the edges of the slot.

The bores are preferably configured in the form of oblong holes. The at least one oblong hole is arranged in the area of the open end of the slot. The oblong hole runs axially. However, the oblong hole or the recess can also have any other geometric shape. The oblong hole preferably has a curvature which in each case faces away from the swivel axis at its apex.

The bore can be provided at the lower end of the slot in the plate.

In these bores, the two sharpening rods and the holding device are hinged to/swivel-mounted on the plate. For this purpose, these bores run from the inside to the outside and are directed relatively slightly downwards. They do not have to be curved if they are sufficiently large to allow a swivelling movement of the sharpening rods guided in them.

In the area of the closed end of the slot, the plate has a bore. The bore in the area of the closed end of the slot has a round shape. The bore in the area of the closed end of the slot can also have any other geometric shape.

The arrangement of the sharpening rods and the bores can also be configured to be inverse in relation to each other.

Sharpening Rod with Points for Holding the Sharpening Rod on the Plate

The material of the sharpening rod is preferably a material which neither additionally blunts nor otherwise damages the knife when the knife comes into contact with the sharpening rod upon insertion of the knife into the slot.

Each of the two sharpening rods is designed to be used as a carrier for at least one sharpening insert.

The sharpening rod is an elongated and/or rod-shaped object. The sharpening rod preferably has a massive shape. The sharpening rod can have a circular cross-section. The cross-section of the sharpening rod can also be square or rectangular or polygonal. It is understood that the sharpening rod can also have any other cross-section.

At least one spring is arranged on each sharpening rod. The respective spring is fastened to the corresponding sharpening rod in a captive manner. At the end of the spring facing the closed end of the slot of the plate, the spring is fastened to the sharpening rod by means of the holding device. At the end of the spring facing the open end of the slot of the plate, the spring is fastened to the sharpening rod by means of a pin of the sharpening rod.

When fixed in the holding device, the two sharpening rods are arranged at an acute angle relative to each other. In the area of the open end of the slot, the springs can be swivelled relative to each other.

The springs are fixed in the holding device and can be moved in this fixed state from a rest position to a sharpening position.

In the area of the closed end of the slot, the sharpening rods are mounted on the plate via a common swivel axis. The swivel axis is configured in the form of a bolt or a pin. In the following, the swivel axis is referred to as a pin.

The swivel axis can also be configured in any other technical shape.

The plate of the knife sharpening device has at least one point at which the at least one sharpening rod is held relative to the plate.

The point at which the sharpening rod is held on the plate may be a bore in the plate. It may be configured in the form of an oblong hole. The oblong hole can be even or curved.

The point at which the sharpening rod is held relative to the plate serves the purpose of holding and/or guiding and/or hinging the sharpening rod relative to the plate.

Three points can be provided at which the sharpening rod is held relative to the plate. Two of them are arranged on either side of the slot. The third point at which the sharpening rod is held relative to the plate can be arranged in the area of the closed end of the slot.

The points at which the sharpening rods are held are arranged on the plate in a V-shape relative to each other.

At least one sharpening rod is designed to be movable in relation to the plate at the point at which it is held on the plate.

The plate can also have at least two points, each of which serves the purpose of holding the same sharpening rod.

The two points can each be used to hold different sharpening rods.

The point at which the sharpening rod is held relative to the plate can be an oblong hole or a bore.

The sharpening rods each have at least one sharpening insert. The two sharpening rods are arranged at an angle relative to each other, preferably in a V-shape. When the knife is inserted between the sharpening rods arranged relative to each other in a V-shape, the blade of the knife comes into contact with at least two sharpening inserts.

One sharpening insert each is assigned to one of the two sharpening rods. Against the restoring force of the aforementioned springs, the sharpening rods are moved from the rest position to the sharpening position by inserting the blade into the slot against the sharpening inserts of the sharpening rods.

The sharpening rods run in a V-shape without intersecting each other. The V-shape within the meaning of the invention may also comprise an arc shape.

By way of non-limiting example, the V-shaped arrangement of the sharpening rods may include an angle ranging from 11° to 21° between the sharpening rods in the area of the holding device.

The V-shaped arrangement of the sharpening rods and the slot are in axial alignment with each other on a common axis.

In the sharpening position, the blade of the knife is in contact on both sides with one sharpening insert of one sharpening rod each.

In the sharpening position, the sharpening rods with the sharpening inserts arranged in and/or on the sharpening rods are exposed to the restoring force of the springs.

The force which the user exerts on the sharpening inserts via the blade to be inserted into the aforementioned slot and indirectly via the sharpening inserts on the sharpening rods leads to a spreading apart of the sharpening rods against the restoring force of the springs. The spreading apart takes place through the upper part of the sharpening rods and is guided and limited by the aforementioned bores, in particular the oblong holes.

In the area of the closed end of the slot arranged in the plate, the two sharpening rods are hinged to the plate via a common swivel axis. The sharpening rods are thus spaced apart from the plate.

A holding device is provided, in which the springs are held with their lower ends. The holding device is hinged to the plate via the swivel axis in such a way that it can be swivelled relative to the plate.

It is provided that the sharpening rod is configured in the form of a protective body. The protective body is intended to prevent the user from coming into contact with the sharpening inserts with his fingers and injuring himself when sharpening, honing and/or polishing the blade of the knife with the aid of the knife sharpening device and/or when assembling the knife sharpening device and/or when maintaining the knife sharpening device.

The two sharpening rods are held at a distance from the plate and can be swivelled relative to the plate.

The movement of the sharpening rods relative to each other takes place in a plane parallel to the plane in which the plate extends.

The pin is arranged on the plate approximately at right angles.

The pin forms an axis around which the sharpening rods can each be swivelled in opposite directions in a plane parallel to the plane of the plate.

Three pins are provided. With the one common pin, the two sharpening rods are held on the plate in the area of the closed end of the slot so that they can swivel. In addition, the common pin holds the holding device relative to the plate.

In the area of the open end of the slot of the plate, two pins are arranged on the sharpening rods. The two pins in the area of the open end of the slot extend parallel to each other. One pin is arranged on each side of a center line of the slot on the plate. Using one of each of the two pins in the area of the open end of the slot, one sharpening rod each is hinged to the plate.

The two pins in the area of the open end of the slot of the plate and the common pin in the area of the closed end of the slot of the plate extend at right angles relative to the plate.

The aforementioned bore through which the common pin protrudes is provided for receiving the pin in the plate.

For the passage of the pins in the area of the open end of the slot, one oblong hole is arranged in the plate on each side of the slot. The oblong hole runs in an approximately arc-shaped manner. The oblong hole is configured in such a way that the pin arranged on the sharpening rod can follow the movement and/or the swivelling movement of the sharpening rod around the swivel axis.

A further advantage of the invention is the fact that only three bores in the plate are required to fasten the sharpening rods and the two springs. As a result, at least one pin for fastening the sharpening rods or the holding device of the springs to the sharpening rods can be omitted.

A pin is provided which passes through the bore arranged in the area of the closed end.

On the rear side of the plate, on which no sharpening rods are arranged, the pins passing through the bores are each held in a captive manner by means of a locking device.

The common pin protrudes through the holding device.

The device for locking the pin of the sharpening rod relative to the plate can be a locking pin and/or a locking ring or any other technical locking element. In the area of the closed end of the slot, the pin penetrates the two sharpening rods.

On the rear side of the plate, the pin is preferably locked against unintentional slipping out of the plate.

The sharpening rod can be made of at least one metal and/or one plastic and/or any other material.

One implementation of the invention provides that in the rest position, the distance of the two sharpening rods from each other corresponds at least to the width of the slot in the plate.

Sharpening Insert

At least one sharpening insert is arranged on each sharpening rod.

This has the effect that a sharpening insert of different type and quality, for example for grinding and/or honing and/or polishing, can be arranged on the sharpening rod.

The sharpening inserts are arranged on the upper side of the sharpening rod. Alternatively, the sharpening insert can be embedded in the sharpening rod. The surface of the sharpening insert is flush with the surface of the sharpening rod.

Alternatively, the sharpening insert can be glued or clamped into the sharpening rod. The sharpening insert can be inserted into the sharpening rod. The sharpening insert can be soldered or welded to the sharpening rod for fastening. It is understood that the sharpening insert can also be fastened to the sharpening rod in any other technical way.

The sharpening rods are arranged relative to each other in a V-shape. The sharpening inserts are arranged on the sharpening rods in such a way that the at least one sharpening insert of the one sharpening rod is located opposite the at least one sharpening insert of the other sharpening rod at the same level.

The sharpening inserts are arranged on the sharpening rods in such a way that the blade of the knife inserted between the sharpening rods comes into contact on both sides with the opposite sharpening inserts.

The knife sharpening device has sharpening inserts which are available over their entire length for processing the blade of the knife.

The sharpening insert is used to sharpen and/or grind and/or hone and/or polish a blunt knife.

The sharpening insert comprises a material that is stronger and/or more resistant than the material of the knife.

The sharpening insert is preferably, but in no way exclusively, made of ceramic and/or stone and/or diamond. It is understood that any other material can also be used. The sharpening insert can also be an oil stone.

Sharpening inserts can be made of a metal. The metal can be a hard metal or a metal alloy or a bimetal.

In another implementation, the sharpening insert is made of Borazon or at least one plastic.

It is understood that the sharpening insert can also be made of a composite material.

Sharpening inserts can also be synthetic grinding stones. By way of non-limiting example, abrasive materials such as corundum, oxide ceramics, non-oxide ceramics and silicon carbide are used.

Likewise, the sharpening insert can be a natural waterstone. By way of non-limiting example, the sharpening insert may consist of a mica stone or phyllite.

The different materials used for the production of the sharpening inserts make it possible to produce sharpening inserts that can be used for grinding and/or honing and/or polishing and/or for knives with serrated edges.

Another implementation of the invention provides that the sharpening inserts have at least two areas for producing different sharpening effects and/or sharpening intensities.

When inserting the blade of the knife between the sharpening rods, which are preferably arranged in a V-shape, and when placing the blade against the sharpening inserts, different sharpening inserts and/or different areas of a sharpening insert can be used depending on the type and purpose of the knife.

It is also provided that in the sharpening position, one sharpening rod in each case is in contact with one side of the blade of the knife with its sharpening insert.

In addition, it is achieved that preferably in the case of knives with serrated edges, the blade can be inserted at an angle relative to the longitudinal axis of the plate between the sharpening rods, which are preferably arranged in a V-shape. In this way, the individual serrations of the serrated edge are sharpened and/or honed and/or polished.

One advantage is that all the sharpening inserts arranged on the sharpening rod and/or all areas of the respective sharpening inserts can be used for grinding and/or honing and/or polishing the knife.

By applying a greater pressure to the blade against the restoring force of the spring, the blade of the knife reaches the lower area of the springs and/or the sharpening inserts in the lower area of the sharpening rod. In particular blunt bevels of a blade can be precisely ground and/or honed and/or polished in this way.

By applying a lower pressure to the blade, the blade of the knife only reaches one area of the sharpening inserts and/or the sharpening inserts in the area of the open end of the sharpening rod as a result of the restoring force of the springs. The lower pressure effect on the blade of the knife results in the blade being ground and/or honed and/or polished in a more gentle manner.

The sharpening rods and/or the sharpening inserts and/or the holding device and/or the springs and/or the pin serving as a swivel axis can be combined to form a replacement module.

This ensures easy assembly of the knife sharpening device by the user. The user can remove the replacement module from the knife sharpener in one piece and replace it by a new replacement module when the sharpening inserts have become blunt after prolonged use.

The replacement module can be inserted into the knife sharpening device in the event that the sharpening rods and/or the sharpening inserts and/or the holding device and/or the springs and/or the pin forming the swivel axis are damaged.

The replacement of the replacement module can be easily carried out by the user without any risk of injury to the user's hands.

Working Areas of the Sharpening Insert

The sharpening insert comprises as working areas a sharpening edge and/or a honing edge and/or a polishing surface.

The sharpening insert is elongated and/or rod-shaped. The sharpening insert is arranged on the surface of the sharpening rod.

The sharpening insert extends along the longitudinal axis of the sharpening rod.

The sharpening rods carrying the sharpening inserts are arranged relative to each other in a V-shape. The sharpening rods can be swivelled in opposite directions around the swivel axis.

When the sharpening rods are swivelled around the swivel axis, the two sharpening rods with the sharpening inserts arranged thereon move radially in opposite directions relative to each other.

Polishing Surface

The sharpening insert comprises at least one surface which is configured in the form of a polishing surface. The polishing surface of the sharpening insert is flush with the surface of the sharpening rod.

The polishing surface is a flat and plane surface.

The polishing surfaces are arranged on the sharpening inserts in such a way that when the sharpening rods are swivelled around the swivel axis, they move radially in opposite directions relative to each other.

For polishing the knife, the blade is pulled horizontally through the sharpening rods. During this process, the bevel of the blade slides on both sides along the polishing surfaces of the sharpening rods arranged in a V-shape.

Polishing the knife involves polishing the previously ground and/or honed bevel of the blade. As a result of the polishing process, the blade is additionally compressed and sharpened still further.

Transversely to the longitudinal axis of the sharpening insert, the surface of the sharpening insert has one end face on each side.

One end face is configured in the form of a sharpening edge. The opposite face forms a honing edge.

Sharpening Edge

The sharpening edges are arranged approximately at right angles relative to the swivel direction of the sharpening rods around the swivel axis. The sharpening edges of the sharpening inserts are arranged relative to the plate in such a way that the sharpening edges of the sharpening inserts of both sharpening rods face the plate.

The end face of the sharpening insert which is configured in the form of a sharpening edge has an angle of between 45° and 89° relative to the surface of the sharpening insert. It is understood that the end face of the sharpening insert configured in the form of a sharpening edge may also have a different angle relative to the surface of the sharpening insert.

For grinding the knife, the blade is pulled through the sharpening rods with the point of the knife facing downwards. During this process, the bevel of the blade slides on both sides along the sharpening edges of the sharpening rods arranged in a V-shape.

When the knife is ground, material is removed from the bevel of the blade as the blade is pulled through.

Honing Edge

The honing edges are arranged approximately at right angles relative to the swivel direction of the sharpening rods around the swivel axis. The honing edges of the sharpening inserts are arranged relative to the plate in such a way that the honing edges of the sharpening inserts of both sharpening rods face away from the plate.

The honing edge is configured in the form of a curved edge. The honing edge can have a round or oval or arc-shaped profile. The honing edge can also have any other geometric shape.

The honing edge is embedded in the sharpening insert. For fixing the sharpening insert to the sharpening rod, the sharpening insert has a carrier.

The honing edge has a profile at least in some areas. The profile has a roughened surface that resembles sandpaper. The profile comprises irregularities, preferably nubs and/or grooves running lengthwise or crosswise. It can also have any other geometric shape.

The honing edge is made of a material which is harder than the material of which the blade of the knife is made.

For honing the knife, the blade is pulled through the sharpening rods with the point of the knife facing upwards. During this process, the bevel of the blade slides on both sides along the honing edges of the sharpening rods arranged in a V-shape.

When the knife is honed, the steel chips or threads of material remaining on the blade as a result of the grinding process are removed from the blade of the knife.

Any irregularities remaining on the blade after the grinding process are levelled when the blade is honed.

Knife

The knife sharpening device is configured not only to grind, but also to hone and polish preferably knives but also scissors and other tools for the chipless cutting of different materials.

The term 'knife' refers to a tool which is used for cutting. The knife comprises a blade as well as a handle. The blade serves to cut a material and/or an object which has a lower material hardness than the material of the blade on the handle.

According to the invention, knives are configured in the form of work knives, professional knives and leisure knives. Knives can be part of a cutlery set or be household and kitchen knives. In addition, knives exist in the form of industrial knives, combat knives, razors and/or ritual knives.

The list of knives is in no way intended to be exclusive but is only exemplary in nature. The knives may also have other shapes and/or functions.

Especially kitchen knives exist in the form of all-purpose or larding knives. In addition, boning knives, bread knives, serrated decorating knives, filleting knives, fruit knives, paring knives, cheese knives, chef's knives, parmesan knives, peeling knives, ham or salmon knives, tomato knives, carving or meat knives, curved chopping knives are known. Also this list is in no way meant to be exclusive but is only exemplary in nature.

In terms of construction, the knife comprises the blade for cutting. The blade has a so-called bevel as a cutting edge.

In terms of material thickness, the bevel is the thinnest area of the blade. The bevel is the area of the blade which is used to cut a material.

Spring

The spring is a metallic technical component that is elastically deformable. The spring produces a restoring force, which returns the spring from a sharpening position to a rest position again after a force acting on the spring has been removed.

The spring of the knife sharpening device has a spring pressure which can be varied according to the type and quality of the knife to be ground. In this way, an optimum grinding result can be achieved.

The spring is made of at least one metallic material.

The spring can be configured in the form of a torsion spring. By way of non-limiting example, the torsion spring can be a bar spring or a coil spring.

The spring can also be configured in the form of a bending spring. The bending spring can have the shape of a leaf spring or be formed as a wire spring. In addition, the spring can be a bar spring.

It is understood that other cross-sections, for example a square or rectangular cross-section, can also be used.

One spring is assigned to one sharpening rod in each case. The spring is held at its lower end in the holding device. In the area of the open end of the slot, the respective spring is fastened to the corresponding sharpening rod.

The swivelling mounting of the two sharpening rods and the holding device for receiving the two springs around the common swivelling axis in the area of the closed end of the slot has the effect that the sharpening rods and the respectively corresponding spring can be swivelled at the same angle and over the same distance when a force is applied against the restoring force of the springs.

The arrangement of the spring on the side of the sharpening rod facing the plate allows the springs to be arranged without any risk of injury.

The arrangement of the springs on the holding device and on the sharpening rod has a more direct effect on the restoring force transferred from the sharpening rod to the sharpening insert.

The two sharpening rods and the spring arranged on each sharpening rod allow a variation of the restoring force that the user can apply to the blade in the upper area and/or in the middle area and/or in the lower area of the sharpening inserts.

The blade of the knife is not at risk of coming into unintentional contact with the springs when being inserted into the slot of the plate, which can lead to additional blunting of the spring.

Due to the fact that the sharpening rod is configured in the form of a protective body, there is no risk that the user might come into contact with the sharpening inserts and/or the spring of the sharpening rods with his fingers and injure himself.

The respective springs are not fastened to the plate but to the sharpening rods and to the holding device.

The restoring force of the spring can be varied. In this way, the pressure acting on the blade of the knife via the sharpening inserts can be adapted to the type and quality and/or the respective function of the knife.

Grinding of the Knife

During grinding, material is removed from the blade in the area of the bevel.

For grinding the blade of the knife, the blade is inserted between the sharpening rods with its point facing downwards. The sharpening rods are arranged in a V-shape.

When the blade of the knife is inserted between the sharpening rods, the bevel of the blade comes into contact on both sides with the sharpening inserts of the sharpening rods arranged opposite each other.

The pressure which the user exerts on the sharpening inserts with the blade when inserting the blade between the sharpening rods is used to move the two springs and the sharpening rods connected to the springs and the sharpening inserts arranged on the sharpening rods from the rest position to the sharpening position against the restoring force of the springs.

As the pressure on the springs is reduced when the blade of the knife is detached from the sharpening inserts of the sharpening rods while the knife is guided out of the slot in the plate, the two springs and the sharpening rods connected to the springs and the sharpening inserts arranged on the sharpening rods are moved from the sharpening position to the rest position as a result of the restoring force of the springs.

The user pulls the blade of the knife from the handle to the point of the blade along the sharpening inserts arranged opposite each other.

By grinding, even very blunt knives can be used again according to their function.

It is understood that the knife can also be ground in the same way from the point of the blade to the handle of the knife.

Honing

During honing, the knife is finely ground. During the honing process, the burrs that form during grinding are removed.

By honing the bevel of the blade, the blade is smoothed after the grinding process.

For honing a blade with the knife sharpening device, the blade of the knife is inserted into the slot of the plate and between the sharpening rods with the point facing upwards.

When the blade of the knife is inserted between the sharpening rods, the bevel of the blade comes into contact on both sides with the sharpening inserts of the sharpening rods arranged opposite each other.

After the blade has been placed against the sharpening inserts of the sharpening rods arranged opposite each other, the blade with its bevel is pulled along the edges of the sharpening inserts from the handle to the point of the blade against the restoring force of the spring.

Honing the blade of the knife with the knife sharpening device keeps the bevel of the blade of the knife permanently sharp.

Polishing

According to the invention, the term 'polishing' is understood to mean a smooth finishing of the bevel of the blade of the knife.

The roughness peaks of the surface structure of the bevel of the blade remaining after grinding and/or honing the knife are plastically and/or partially plastically deformed and levelled.

In addition, there is a minimal material removal of the bevel of the blade of the knife during polishing. The polishing process can also be used to fill in recesses in the area of the bevel of the blade of the knife.

When the bevel of the blade is polished, the user pushes the sharpening rods with the sharpening inserts arranged thereon outwards against the restoring force of the corresponding springs relative to the center line of the slot in the plate.

The blade of the knife is inserted into the slot approximately parallel to the stand of the knife sharpening device.

The bevel of the blade of the knife comes into contact with the sharpening inserts of the two sharpening rods arranged at an angle relative to each other. For polishing, the blade of the knife is guided along the sharpening inserts with its bevel running approximately parallel to the stand of the plate.

During the polishing process, the user moves the bevel of the blade of the knife along the sharpening inserts without additional restoring force.

Grinding of a Knife with a Serrated Edge

According to the invention, the term 'serrated edge' is understood to mean a ground edge of the blade of the knife with so-called saw teeth.

For grinding the blade of the knife with a serrated edge, the blade is inserted horizontally between the sharpening rods. The sharpening rods of the knife sharpening device are arranged in a V-shape.

When the blade of the knife with a serrated edge is inserted between the sharpening rods, both sides of the bevel of the blade come into contact with the sharpening inserts of the sharpening rods arranged opposite each other.

The pressure which the user exerts on the sharpening inserts with the blade when inserting the blade between the sharpening rods is used to move the two springs and the sharpening rods connected to the springs from the rest position to the sharpening position against the restoring force of the springs.

The point of the knife is swivelled to the side of the serrated edge of the blade relative to a longitudinal axis of the plate running through the swivel axis.

When grinding a knife with a serrated edge, the user pulls the blade of the knife horizontally along the sharpening inserts of the sharpening rods with moderate restoring force.

As the pressure on the springs is reduced when the blade of the knife is detached from the sharpening inserts of the sharpening rods while the knife is guided out of the slot in the plate, the two springs and the sharpening rods connected to the springs are moved from the sharpening position to the rest position as a result of the restoring force of the springs.

The advantage is that the serrations of the serrated edge of the blade can be sharpened individually.

The individual serrations in the serrated edge are preserved due to the sharpening by means of the knife sharpening device.

Advantages of the Invention

The approximately V-shaped arrangement of the points at which the sharpening rods are guided and/or hinged and/or held relative to the plate has the effect that the blade of the knife can be ground and/or honed and/or polished over the entire length of the two sharpening inserts.

Another advantage of the invention is that the knife sharpening device requires a reduced number of individual parts and components. As a result, the manufacturing costs can be further reduced.

The design of the knife sharpening device allows easier assembly by the user and/or the manufacturer. In addition, a more robust construction can be achieved.

DESCRIPTION OF THE DRAWINGS

Further examples and implementations of the invention are described in more detail with reference to the drawings, in which.

DETAILED DESCRIPTION

Figure 1:
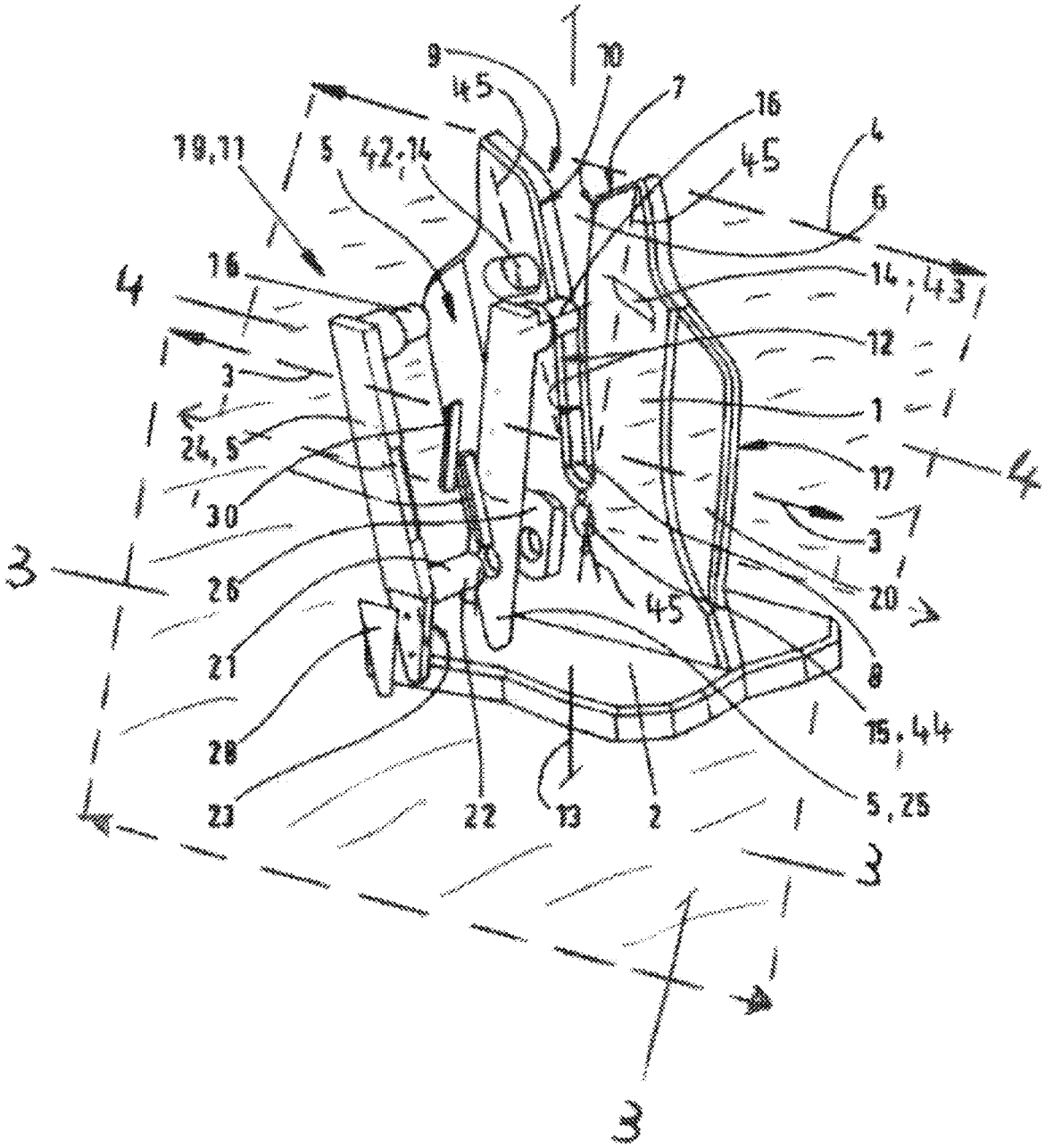
FIG. 1 shows an exploded view of the knife sharpening device.

FIG. 1 shows the knife sharpening device 11 with a plate 1, which is fastened approximately vertically to a stand 2.

The two sharpening rods 24; 25 are arranged in a plane 3, which extends approximately parallel to a plane 4 of the plate 1. The sharpening rods 24; 25 are shown in FIG. 1 in a V-shaped arrangement 5. In addition, the knife sharpening device 11 comprises sharpening rods 24, 25 which, in a rest position 19, are arranged at a predetermined angle relative to each other by the force of one spring 29 in each case.

The plate 1 has a slot 6, which comprises an upper open end 7 and a lower closed end 8.

The slot 6 has an insertion area 9.

The insertion area 9 serves to insert a knife (not shown) into the slot 6 of the plate 1 between the sharpening rods 24; 25.

In order to delimit the slot 6 from the plate 1, the plate 1 has edges 10.

Reference numeral 10 indicates the edges of the slot 6 in the plate 1 of the knife sharpening device 11.

FIG. 1 shows a center line 13 of the slot 6. In the area of the open end 7 of the slot 6, one oblong hole 14 is arranged in the plate 1 on each side (12) of the center line 13.

In the area of the closed end 8 of the slot 6, a bore 15 is arranged in the plate 1, which has a circular diameter in FIG. 1.

The two oblong holes 14 each serve to receive one pin 16 of each sharpening rod 24; 25.

The pin 16 of the respective sharpening rod 24; 25 passes through the bore 14, which is configured in the form of an oblong hole. In order to hinge the two sharpening rods 24; 25 to the plate 1 in a captive manner, the pins 16 are protected on the rear side 17 of the plate 1 facing away from the sharpening rods 24; 25 preferably by a captive securing means 18 (not shown) to prevent them from slipping out of the oblong holes 14.

On both sides (12) of the center line 13 of the slot 6, grip elements 20 are arranged on the plate 1.

A pin 21 is provided, which forms the swivel axis 22.

The pin 21 is provided on one side 23 of the sharpening rod 24 facing away from the plate 1.

The pin 21 penetrates a sharpening rod 25 arranged between the sharpening rod 24 and the plate 1.

The pin 21 penetrates a holding device 26.

For hinging the two sharpening rods 24; 25 and the holding device 26 to the plate 1, the pin 21 penetrates the plate 1. The pin 21 is held on the rear side 17 of the plate 1 facing away from the sharpening rods 24; 25 with a captive securing means 18 (not shown).

The sharpening rod 24 has a faceplate 28.

The holding device 26 serves as a carrier for the springs 29, which are not shown.

It is not shown either that the springs 29 are fastened to the sharpening rods 24 and 25 with their upper ends facing away from the holding device 26.

A sharpening insert 30 is arranged in the sharpening rod 24.

The sharpening insert 30 intended for replacement is shown in the area of the sharpening rods 24; 25.

FIG. 1 shows three points 42, 43, 44 of the plate 1, at which the sharpening rods 24; 25 are held on the plate 1.

The points 42, 43, 44 of the plate 1 are arranged relative to each other in a V-shape 45.

Figure 2:
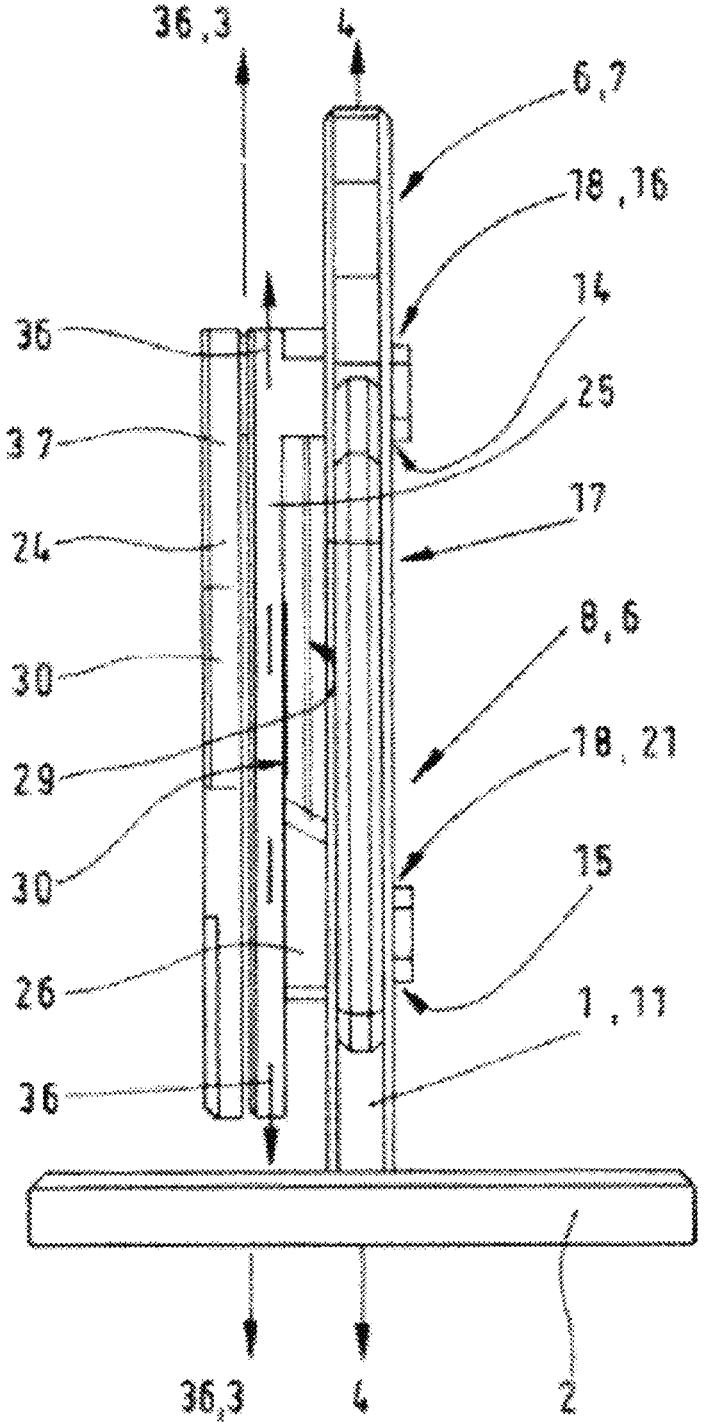
FIG. 2 shows a side view of the knife sharpening device in its assembled state.

FIG. 2 shows the plate 1 of the knife sharpening device 11, which is arranged approximately vertically to the stand 2 on the latter.

The side view of the knife sharpening device 11 shows the holding device 26.

In the area of the open end 7 and the closed end 8 of the slot 6, the captive securing means 18 are shown. The pins 21; 16 are secured against slipping out of the bores 15; 14 by means of the captive securing means 18.

The pin 21 is arranged on the sharpening rod 24. The pin 21 passes through the sharpening rod 25. The pin 21 penetrates the holding device 26.

On the rear side 17 of the plate 1 facing away from the sharpening rods 24; 25, the pin 21 penetrates the bore 15 in the plate 1. The pin 21 is held on the plate 1 with the captive securing means 18 so that it is captive and can be swivelled relative to the plate 1.

The sharpening inserts 30 are arranged in the sharpening rods 24 and 25.

The side view of FIG. 2 shows a spring 29.

FIG. 2 shows the spring 29 of the sharpening rod 24. At its lower end, the spring 29 is fastened to the holding device 26. At its upper end, the spring 29 is fastened to the sharpening rod 25.

The plate 1 extends in the plane 4. The plane 3, in which the sharpening rods 24 and 25 extend, runs parallel thereto.

Figure 3:
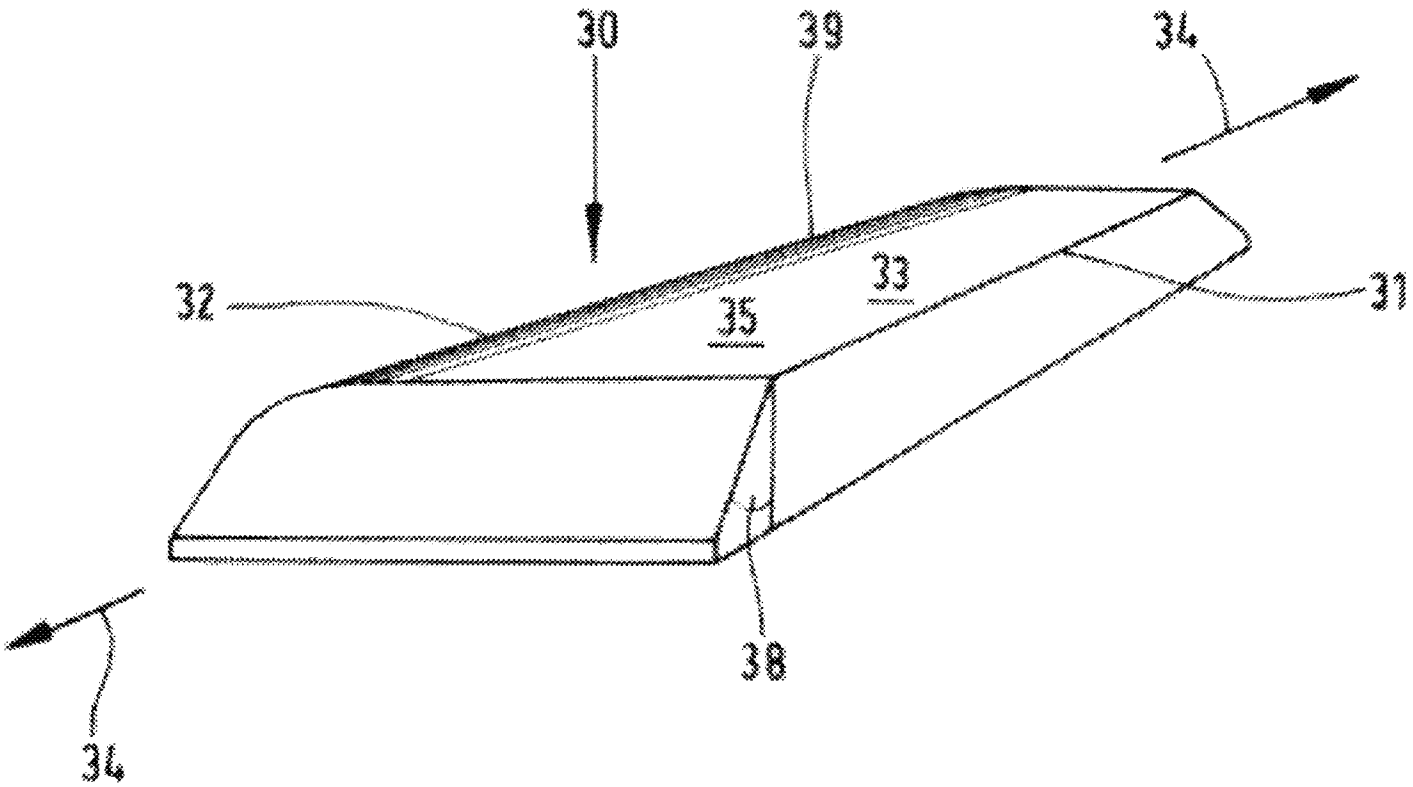
FIG. 3 shows the sharpening insert with its working areas.

FIG. 3. shows the sharpening insert 30, which is elongated and/or rod-shaped. The sharpening insert 30 is arranged on the surface 37 of the sharpening rod 24; 25.

The sharpening insert 30 has a surface 35, which is flush with the surface 37 of the sharpening rod 24; 25.

The sharpening insert 30 extends along the longitudinal axis 36 of the sharpening rod 24; 25.

The sharpening rods 24; 25 (not shown) carrying the sharpening inserts 30 are arranged relative to each other in a V-shape 5. The sharpening rods 24; 25 can be swivelled in opposite directions around the swivel axis 22.

When the sharpening rods 24; 25 are swivelled around the swivel axis 22, the two sharpening rods 24; 25 with the sharpening inserts 30 arranged thereon move radially in opposite directions relative to each other.

The sharpening insert 30 comprises at least one surface 35, which is configured in the form of a polishing surface 33. The polishing surface 33 is a flat and plane surface.

The polishing surfaces 33 are arranged on the sharpening inserts 30 in such a way that when the sharpening rods 24; 25 are swivelled around the swivel axis 22, they move radially in opposite directions relative to each other.

For polishing the knife, the blade is pulled horizontally through the sharpening rods 24; 25. During this process, the bevel of the blade slides on both sides along the polishing surfaces 33 of the sharpening rods 24; 25 arranged in a V-shape.

Polishing the knife involves polishing the previously ground and/or honed bevel of the blade. As a result of the polishing process, the blade is additionally compressed and sharpened still further.

Transversely to the longitudinal axis 34 of the sharpening insert 30, the surface 35 of the sharpening insert 30 has one end face on each side.

One end face is configured in the form of a sharpening edge 31. The opposite face forms a honing edge 32.

The sharpening edges 31 are arranged approximately at right angles relative to the swivel direction of the sharpening rods 24; 25 around the swivel axis 22. The sharpening edges 31 of the sharpening inserts 30 are arranged relative to the plate 1 in such a way that the sharpening edges 31 of the sharpening inserts 30 of both sharpening rods 24; 25 face the plate 1.

The end face of the sharpening insert 30 which is configured in the form of a sharpening edge 31 has an angle 38 of approximately 88° relative to the surface of the sharpening insert 30.

It is understood that the end face of the sharpening insert configured in the form of a sharpening edge 31 may also have a different angle relative to the surface 35 of the sharpening insert 30.

For grinding the knife, the blade is pulled through the sharpening rods 24; 25 with the point of the knife facing downwards. During this process, the bevel of the blade slides on both sides along the sharpening edges 31 of the sharpening rods 24; 25 arranged in a V-shape.

When the knife is ground, material is removed from the bevel of the blade as the blade is pulled through.

The honing edges 32 are arranged approximately at right angles relative to the swivel direction of the sharpening rods 24; 25 around the swivel axis 22. The honing edges 32 of the sharpening inserts 30 are arranged relative to the plate 1 in such a way that the honing edges 32 of the sharpening inserts 30 of both sharpening rods 24; 25 face away from the plate 1.

The honing edge 32 is configured in the form of a curved edge. The honing edge 32 can have a round or oval profile 39. The honing edge 32 can also have any other geometric shape.

The honing edge 32 has a profile 39 at least in some areas. The profile 39 has a roughened surface that resembles sandpaper. The profile 39 comprises irregularities, preferably nubs and/or grooves running lengthwise or crosswise. It can also have any other geometric shape.

The honing edge 32 is made of a material which is harder than the material of which the blade of the knife is made.

For honing the knife, the blade is pulled through the sharpening rods 24; 25 with the point of the knife facing upwards. During this process, the bevel of the blade slides on both sides along the honing edges 32 of the sharpening rods 24; 25 arranged in a V-shape.

When the knife is honed, the steel chips or threads of material remaining on the blade as a result of the grinding process are removed from the blade of the knife.

Any irregularities remaining on the blade after the grinding process are levelled when the blade is honed.

Figure 4:
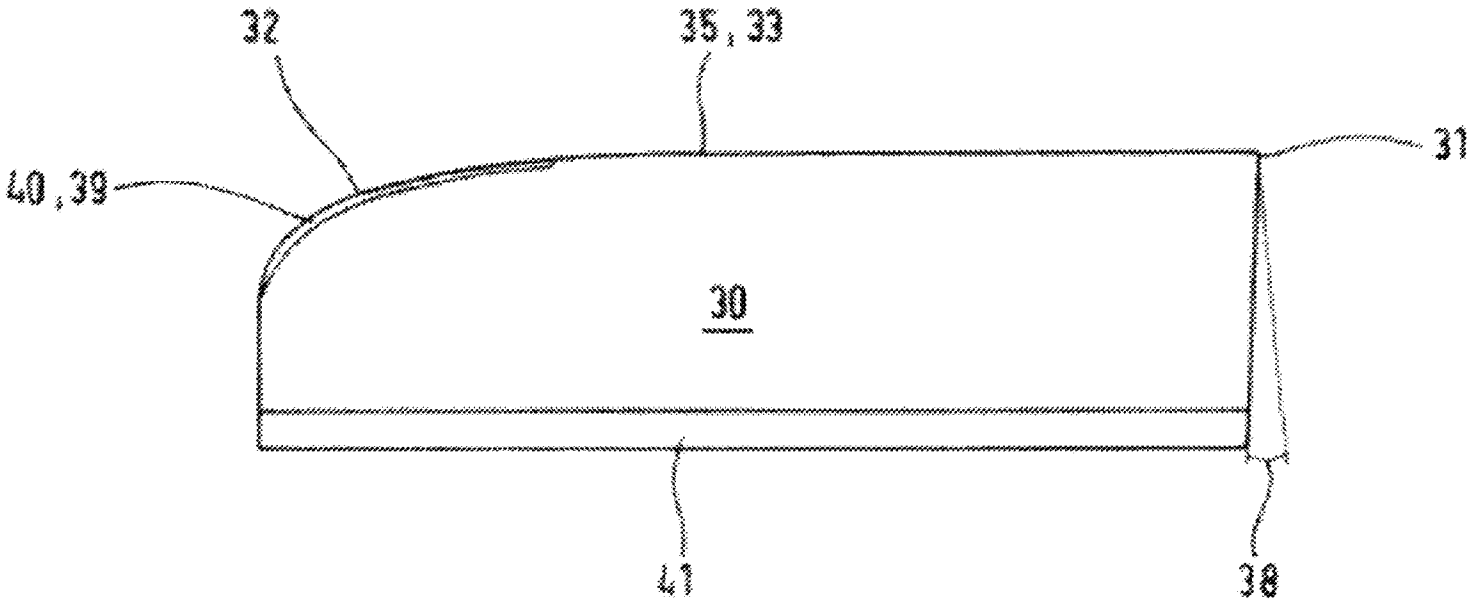
FIG. 4 shows a lateral sectional view of the sharpening insert.
Figure 5:
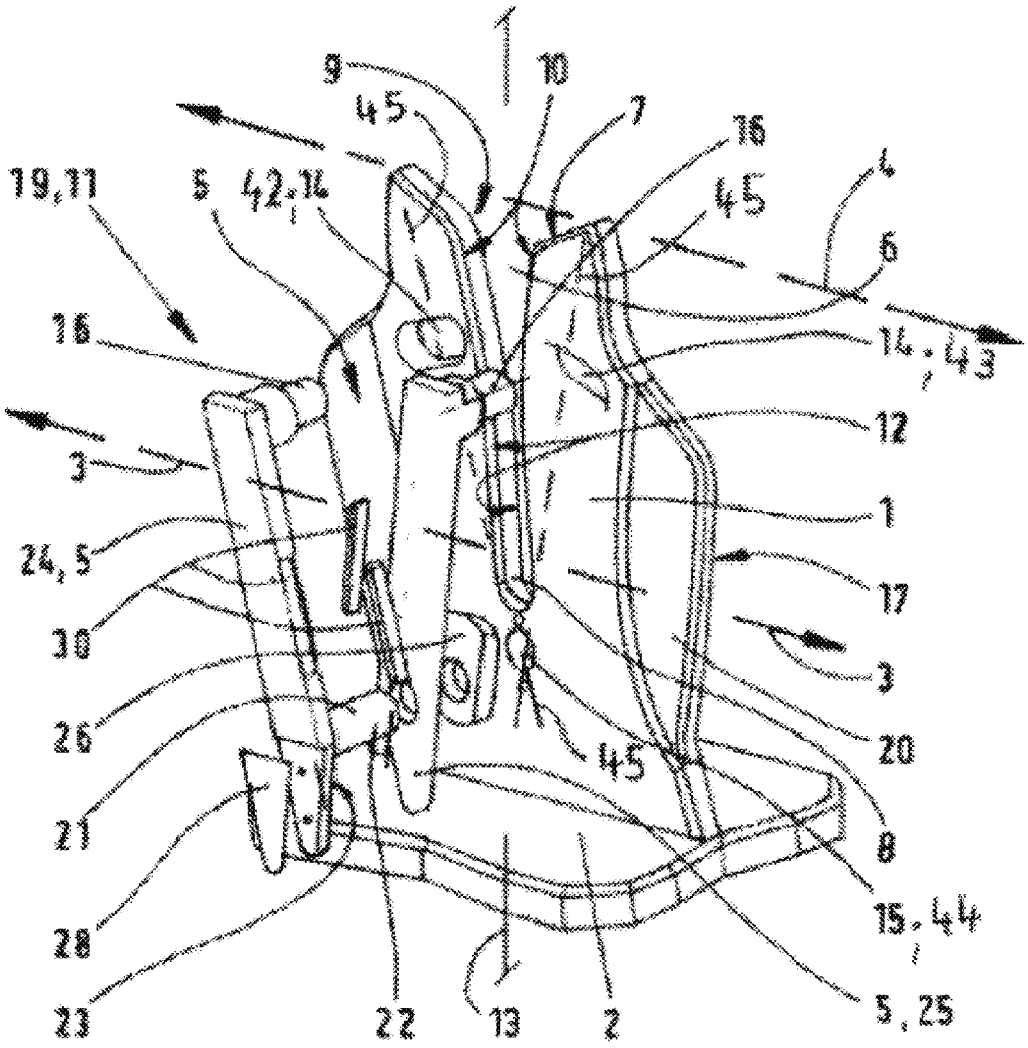
FIG. 5 shows the abstract drawing.

FIG. 4 shows a lateral sectional view of the sharpening insert 30 according to FIG. 3.

The sharpening insert 30 has the surface 35, which is configured in the form of a polishing surface 33. As illustrated in FIG. 4, the two end faces of the sharpening insert 30 are shown on the right and left of the surface 35 of the sharpening insert 30.

The one end face is configured in the form of a sharpening edge 31. On the opposite end face, the honing edge 32 is arranged.

The sharpening edge 31 extends at an angle 38 of approximately 88° relative to the surface 35 of the sharpening insert 30.

The honing edge 32 is shown on the opposite end face. The honing edge 32 shown in FIG. 4 has a profile 39 comprising grooves 40.

The honing edge 32 is arc-shaped and embedded in the sharpening insert 30.

For fixing the sharpening insert 30 to the sharpening rod 24; 25, the sharpening insert 30 has a carrier 41.

REFERENCE NUMERALS

1 plate
2 stand
3 plane of the sharpening rod
4 plane of the plate
5 V-shaped arrangement of the sharpening rods
6 slot
7 upper end of the slot
8 lower end of the slot
9 insertion area of the slot
10 edges of the plate
11 knife sharpening device
12 side of the slot in the plate
13 center line of the slot
14 oblong hole
15 bore
16 pin of the sharpening rod
17 rear side of the plate
18 captive securing means
19 rest position

20 grip element
21 pin of the sharpening rod
22 swivel axis; pin
23 side of the sharpening rod facing away from the plate
24 sharpening rod with pin
25 sharpening rod
26 holding device
27 remains unassigned
28 faceplate
29 spring
30 sharpening insert
31 sharpening edge
32 honing edge
33 polishing surface
34 longitudinal axis of the sharpening insert
35 surface of the sharpening insert
36 longitudinal axis of the sharpening rod
37 surface of the sharpening rod
38 angle
39 profile
40 grooves
41 carrier of the sharpening insert
42, 43, 44 holding point
45 V-shape of the holding points

The invention claimed is:

1. A knife sharpening device comprising:

a plate with two sharpening rods, which are arranged on the plate so that the sharpening rods can swivel, wherein the plate has a slot, which is open at one end and closed at an opposite end;

wherein the sharpening rods and the slot are arranged in axial alignment with each other and serve to insert a knife, wherein the sharpening rods each have at least one sharpening insert, wherein the sharpening rods are kept at a predetermined distance from each other in a rest position by a force of one spring in each case, wherein the sharpening rods can be spread apart against the force of the spring in a sharpening position upon insertion of the knife when the knife comes into contact with the sharpening inserts, wherein the plate has three points, at which the sharpening rods are held relative to the plate, wherein two points of the three points at which the sharpening rods are held relative to the plate, are arranged at either sides in an area of the open end of the slot, wherein the sharpening rods are commonly held at one point of the three points at which the sharpening rods are held relative to the plate, wherein the one point is arranged in an area of the closed end of the slot, wherein in the area of the closed end of the slot, the two sharpening rods are mounted on the plate via a common swivel axis, wherein in the rest position, the distance of the two sharpening rods from each other corresponds at least to a width of the slot in the plate, and wherein a polishing surface is a surface of the sharpening insert which has end faces extending transversely to a longitudinal axis of the sharpening insert, one end face of which is a sharpening edge and the opposite end face is a honing edge, wherein the honing edge has a profile comprising grooves.

2. The knife sharpening device according to claim 1, wherein the three points, at which the sharpening rods are held on the plate, are arranged relative to each other in a V-shape.

3. The knife sharpening device according to claim 2, further comprising a bore that is an oblong hole.

4. The knife sharpening device according to claim 1, wherein at least one sharpening rod is movable at the point at which the at least one sharpening rod is held on the plate.

5. The knife sharpening device according to claim 1, wherein the plate three points are configured to hold at least two sharpening rods.

6. The knife sharpening device according to claim 1, wherein each of the three points in the plate are oblong holes or a bore.

7. The knife sharpening device according to claim 1, wherein the plate has at least one grip element on at least one of two sides of the slot.

8. The knife sharpening device according to claim 1, wherein the plate has one bore on each side of the slot and the sharpening rod positioned in an area of the respective bore has a pin, by means of which the sharpening rod engages the bore.

9. The knife sharpening device according to claim 1, wherein the plate is composed of a cut-resistant material.

10. The knife sharpening device according to claim 1, wherein the slot in the plate has a width which increases exponentially from its closed end towards its open end.

11. The knife sharpening device according to claim 1, wherein the sharpening rods are configured in the form of a protective body, which protects the sharpening insert arranged on the respective sharpening rod against contact by a user and/or against damage and/or against visibility.

12. The knife sharpening device according to claim 1, wherein the sharpening rod is configured in the form of a protective body, which protects the spring arranged on the respective sharpening rod against contact by a user and/or against damage and/or dirt and/or against visibility and which prevents the user from coming into contact with the sharpening inserts.

13. The knife sharpening device according to claim 1, wherein one spring is arranged on one sharpening rod in each case.

14. The knife sharpening device according to claim 1, wherein the spring is a bending spring or a torsion spring.

15. The knife sharpening device according to claim 1, wherein the restoring force of the spring directed towards a center line of the slot varies when the sharpening rods move from the rest position to the sharpening position.

16. The knife sharpening device according to claim 1, wherein one spring is arranged on each sharpening rod, wherein the springs are fixed in a holding device and can be moved in this fixed state from a rest position to a sharpening position against the restoring force of the springs.

17. The knife sharpening device according to claim 1, wherein the sharpening insert comprises at least one diamond and/or one ceramic and/or one stone.

18. The knife sharpening device according to claim 1, wherein the at least one sharpening insert, arranged on each sharpening rod, has areas for producing different sharpening effect and/or sharpening intensity.

19. The knife sharpening device according to claim 1, further comprising a swivel axis arranged approximately at right angles relative to the plate.

20. The knife sharpening device according to claim 1, wherein the sharpening rods and/or the sharpening inserts and/or a holding device and/or the springs are combined to form a replacement module, wherein the replacement module is configured to be removed from the knife sharpener in one piece and replaced by a new replacement module when the sharpening inserts become blunt after prolonged use.

21. The knife sharpening device according to claim 1, wherein in the sharpening position, one sharpening rod in each case is in contact with one side of the knife with its sharpening insert.

22. The knife sharpening device according to claim 1, wherein the sharpening insert comprises as working areas a sharpening edge and/or a honing edge and/or a polishing surface, wherein the honing edge is configured in the form of a curved edge.

23. The knife sharpening device according to claim 1, wherein sharpening edges of the sharpening inserts of both sharpening rods face the plate, wherein the sharpening edges are arranged at right angles relative to the swivel direction of the sharpening rods around a swivel axis.

24. The knife sharpening device according to claim 1, wherein honing edges of the sharpening inserts of both sharpening rods face away from the plate, wherein the honing edges are arranged at right angles relative to the swivel direction of the sharpening rods around a swivel axis.

25. The knife sharpening device according to claim 1, wherein a first one of the sharpening rods comprises a pin and a second one of the sharpening rods comprises a corresponding opening through which the pin extends through such that the first one and the second one of the sharpening rods are rotatably affixed at the common swivel axis.

* * * * *